US005272864A

United States Patent [19]

Suzuki

[11] Patent Number: 5,272,864

[45] Date of Patent: Dec. 28, 1993

[54] YARN EXCHANGE AND DOFFING DEVICE IN TWO-FOR-ONE TWISTER

[75] Inventor: Tadashi Suzuki, Uji, Japan

[73] Assignee: Murata Kikai Kabushiki Kaisha, Kyoto, Japan

[21] Appl. No.: 921,372

[22] Filed: Jul. 29, 1992

Related U.S. Application Data

[63] Continuation of Ser. No. 697,265, May 8, 1991, abandoned.

[30] Foreign Application Priority Data

May 14, 1990 [JP] Japan ..... 2-49065[U]

[51] Int. Cl.[5] ..... D01H 9/10; D01H 7/86

[52] U.S. Cl. ..... 57/268; 57/264; 57/265; 57/266; 57/281

[58] Field of Search ..... 57/264, 265, 266, 268, 57/270, 271, 276, 281

[56] References Cited

U.S. PATENT DOCUMENTS

| | | | |
|---|---|---|---|
| 3,638,412 | 2/1972 | Rebsamen | 57/264 |
| 3,672,143 | 6/1972 | Whitney | 57/264 |
| 3,902,308 | 9/1975 | Bernstein et al. | 57/264 X |
| 4,028,869 | 6/1977 | Schafer et al. | 57/264 |
| 4,598,869 | 7/1986 | Uchida et al. | 57/281 |
| 4,823,544 | 4/1989 | Igel | 57/265 |
| 4,928,475 | 5/1990 | Matsui et al. | 57/281 X |
| 4,928,476 | 5/1990 | Otoshima et al. | 57/281 X |
| 5,136,833 | 8/1992 | Inger | 57/270 X |

*Primary Examiner*—Daniel P. Stodola
*Assistant Examiner*—William Stryjewski
*Attorney, Agent, or Firm*—Spensley Horn Jubas & Lubitz

[57] ABSTRACT

A yarn exchange and doffing device in a two-for-one twister without lowering of efficiency is proposed. A yarn breakage spindle passing mechanism is provided on the device body which travels along spindles of a two-for-one twister and the mechanism stores a yarn breakage spindle judged to be unnecessary for stoppage.

3 Claims, 2 Drawing Sheets

YARN EXCHANGE AND DOFFING DEVICE IN TWO-FOR-ONE TWISTER

This is a continuation of application Ser. No. 07/697,265 filed on May 8, 1991, now abandoned.

FIELD OF THE INVENTION

The present invention relates to a yarn exchange and doffing device in a two-for-one twister for automatically carrying out exchange of yarns and doffing.

RELATED ART STATEMENT

A two-for-one twister is used to pass a yarn drawn out of a yarn feed package supported on a spindle therethough to thereby apply a double twist thereto, and wind it on a take-up tube supported on a cradle to form a wound package.

When the take-up tube winds all yarns on the yarn feed package to form a fully wound package, an empty yarn feed package is exchanged with the full yarn feed package (exchange of yarns), the yarn end is drawn out of the package to pass it through a center hole, the fully wound package is removed from the cradle and a new take-up tube is supported (doffing) on the cradle, and the yarn end drawn out of the package is fixed to the take-up tube.

In the past, these operations have been carried out by hand.

However, recently, with the trend of production of many kinds and in small volume, frequency of operations such as yarn exchange and doffing increases. Automated operations have been desired in order to reduce labors and improve productivity.

In view of the foregoing, the present applicant has developed an apparatus for automatically carrying out the yarn exchange and doffing, and various considerations have been made to put it to practical use. However, this apparatus detects a spindle for which winding is discontinued (a yarn-breakage spindle) and actuates accordingly. Therefore, the device repeatedly stops for a spindle of yarn breakage halfway for which yarn exchange and doffing operation are not necessary before piecing is done, possibly lowering the work efficiency. Apparatus for solving such a task has not been proposed heretofore.

OBJECT AND SUMMARY OF THE INVENTION

In view of the above-described circumstances, the present invention has been accomplished so as to provide a yarn exchange and doffing device in a two-for-one twister without lowering of efficiency.

According to the present invention, a yarn-breakage spindle passing mechanism is provided on the device body which travels along spindles of a two-for-one twister to effect yarn-exchange and doffing, said mechanism storing a yarn-breakage spindle judged to be unnecessary for stoppage and passing said spindle when the device again arrives at said spindle in the same state.

With the above-described arrangement, the yarn-breakage spindle passing mechanism is provided to prevent repeated stoppages with respect to a spindle of yarn breakage halfway for which yarn exchange and doffing are not necessary to effect detection operation.

DETAILED DESCRIPTION OF PREFERRED EMBODIMENTS

An embodiment of the present invention will be described hereinafter with reference to the accompanying drawings.

Figure 1:
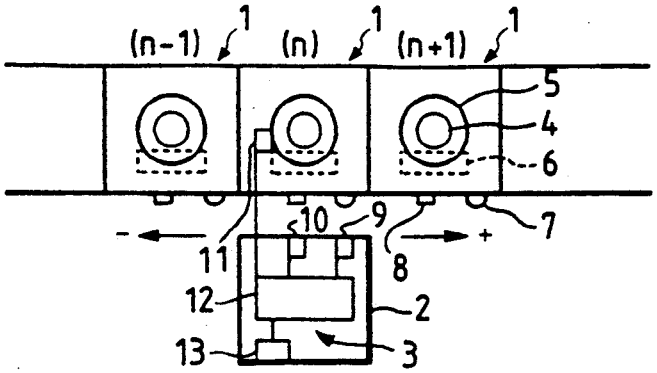
FIG. 1 is a plan view showing one embodiment of a yarn exchange and doffing device in a two-for-one twister according to the present invention.

FIG. 1 shows one embodiment of a yarn exchange and doffing device in a two-for-one twister according to the present invention. A yarn breakage spindle passing mechanism 3 is provided on the device body 2 which moves along spindles 1 of a two-for-one twister to effect yarn exchange and doffing.

A yarn feed package 5 stood upright on a spindle 4 is set to each spindle 1, and suitably twisted and wound as a wound package 6. Frontwardly thereof are mounted a green lamp 7 which is turned on when a yarn breakage occurs, and a magnet 8 indicative of a lot number of the spindle 1.

The yarn breakage spindle passing mechanism 3 comprises sensors 9 and 10 for sensing the green lamp 7 and the magnet 8, a residual yarn detection sensor 11 for detecting presence or absence of the residual yarn on the yarn feed package 5, and a controller 12 connected with the sensors 9, 10 and 11, the controller 12 having a travel and drive device 13 for reciprocating the device body 2 connected thereto.

The controller 12 houses therein a counter (not shown) for receiving a signal from the magnet sensor 10. The counter counts plus (+) when in movement to right and minus (−) when in movement to left in the figure, and relative lot numbers (. . . , n−1, n+1, . . .) indicative of positions of the spindles are inputted.

The controller 12 further comprises a memory and processing section (not shown) for storing and judging information inputted from the sensors 9 . . . 11 and outputting instructions of travel (passage) or stoppage to the travel and drive device 13. That is, in the case where whether or not the yarn exchange and doffing are carried out with respect to the spindle 1 is judged and the fact that stoppage is not necessary due to the presence of residual yarn is judged, a lot number (n) of the yarn breakage spindle 1 is stored, and if the same state is present when the device arrives at the spindle 1, the spindle 1 is allowed to pass.

Next, the structure of the spindle 1 and the device body 2 of the two-for-one twister will be described with reference to FIG. 2.

The spindle 1 of the two-for-one twister is provided downwardly with a spindle 4 for vertically supporting the yarn feed package 5 and upwardly with a cradle arm 15 for horizontally supporting a take-up tube 14 so that yarn Y drawn out of the package 5 is guided upwardly while double twisting passing through an axial hole 16 thereof and wound on the take-up tube 14 rotated and driven by a rotary drum 17 to form a predetermined wound package 6.

A cradle arm 15 is pivotally supported to be elevated to place the wound package 6 in contact with, or to move it away from, the rotary drum 17, and is connected to a cylinder 18 for raising the package to a doffing position. Upwardly of the cradle arm 15 is mounted a stocker 19 storing therein a plurality of take-up tubes 14.

Further, upwardly of the yarn feed package 5 are arranged in order of a snail wire 20 for guiding the yarn Y, a drop wire 21 to be engaged with the yarn Y, a yarn guide roller 22 and a feed roller 23 for supplying the yarn Y to the wound package 6.

The end of the drop wire 21 is supported on a lateral shaft 24 arranged at the rear of the package 5, and the extreme end of drop wire 21 is erected on the yarn Y between the snail wire 20 and the yarn guide roller 22 so that when the yarn Y on the package 5 is empty or an end breakage occurs, it falls on the package 5 due to its own weight. Mounted on the lateral shaft 24 is a cam 26 for opening and closing an operating valve 25 of a cylinder 18 for the cradle arm so that when the drop wire 21 falls, the operating valve 25 is opened, and the cradle arm 15 is raised to a doffing position by the cylinder 18.

The aforesaid green lamp 7 is mounted upwardly of the stocker 19 so that when the cradle arm 15 is raised, the green lamp is lit. The end of the snail wire 20 is horizontally rotatably supported through a bracket 27 so that when the package 5 is exchanged, the wire 20 can escape rearwardly.

A delivery conveyor 28 for delivering the doffed wound package 6 at the rear of the rotary drum 17 and a conveyor 30 for carrying the full package while being placed on the tray 29 frontwardly of the package 5 are extended along the spindles 1 juxtaposed.

The device body 2 comprises a yarn exchange mechanism 31 for exchange of yarns and a doffing mechanism 32 for doffing, which are loaded on a carriage 33 which travels along the spindles 1 juxtaposed. Rails 35 and 36 are mounted above and below on the front side of a unit 34 constituting the spindles 1 so that the carriage 3 is supported on the unit 34 to be travelled through wheels 37 and 38 which roll on the rails 35 and 36. The aforesaid travel and drive device 13 is connected to the lower wheel 38.

The lamp sensor 9 is mounted at the upper portion of the carriage 33 so that when the lighting state of the green lamp 7 is detected by the sensor 9, the travel and drive device 13 is reduced in speed and stopped, and the carriage 33 is located and stopped on the front side of the spindle 1. The magnet 8 and the magnet sensor 10 are mounted opposedly of the lower portion of the unit 34 and the lower portion of the carriage 33.

The yarn exchange mechanism 31 has an operating arm 39 provided vertically movably and to be elevated on the carriage 33 so that the mechanism 31 is extended upwardly of the yarn package 5 on the spindle 4 when in horizontal state, and the residual yarn detection sensor 11 is mounted on the extreme end of the mechanism 31.

An expansion arm (not shown) to be expanded forwardly is mounted on the operating arm 39 so that the extreme end of the expansion arm is engaged with the drop wire 21 and the snail wire 20 so as to be returned to its original position. A chucker 40 is provided slidably in a longitudinal direction on the operating arm 39 so as to hold the yarn package 5 and a tensor cap 41 detachably mounted in the axial hole 16.

The exchange of yarns is accomplished by transferring the yarn package on the peg 42 of the tray 29 to the yarn end finding peg 43 provided on the carriage 33 by the sliding of the chucker 40 and the vertical movement of the operating arm 39, transferring an empty yarn package on the spindle 4 onto the peg 42 of the tray 29, and transferring the yarn package subjected to yarn end finding from the yarn end finding peg 43 to the spindle 4.

The doffing mechanism 32 comprises an operating lever 45 for operating a cradle lever 44 of the cradle arm raised to the doffing position, a tray 46 for receiving the fully wound package 6 which is struck by the operating lever 45 to roll it onto the delivery conveyor 28, and a take-up tube supply arm 47 for removing the take-up tube 14 from the stocker 19 to supply it to the cradle arm 15.

The operating lever 45 is mounted on a drive shaft 48 provided rotatably and axially slidably so that in doffing, the lever 45 turns internally of the cradle lever 44 and then slidably moves to open the cradle arm 15.

The tray 46 is connected and supported through a parallel link 49 on a rotary shaft 58 mounted on the carriage 33 so that in doffing, the tray 46 is extended directly under the wound package 6 by the rotation of the rotary shaft 58.

A take-up tube supply arm 47 is mounted on a rotary shaft 50 supported on the carriage 33, and a take-up tube chucker 51 for detachably holding the take-up tube 14 is mounted on the extreme end thereof. When the take-up tube 14 is removed from the stocker 19, the take-up tube supply arm 47 turns downward and stands-by, and after a bunch has been formed in the take-up tube 14, it is delivered to the cradle arm 15 and the arm 47 is turned upwardly of the carriage 33 and received.

Figure 3:
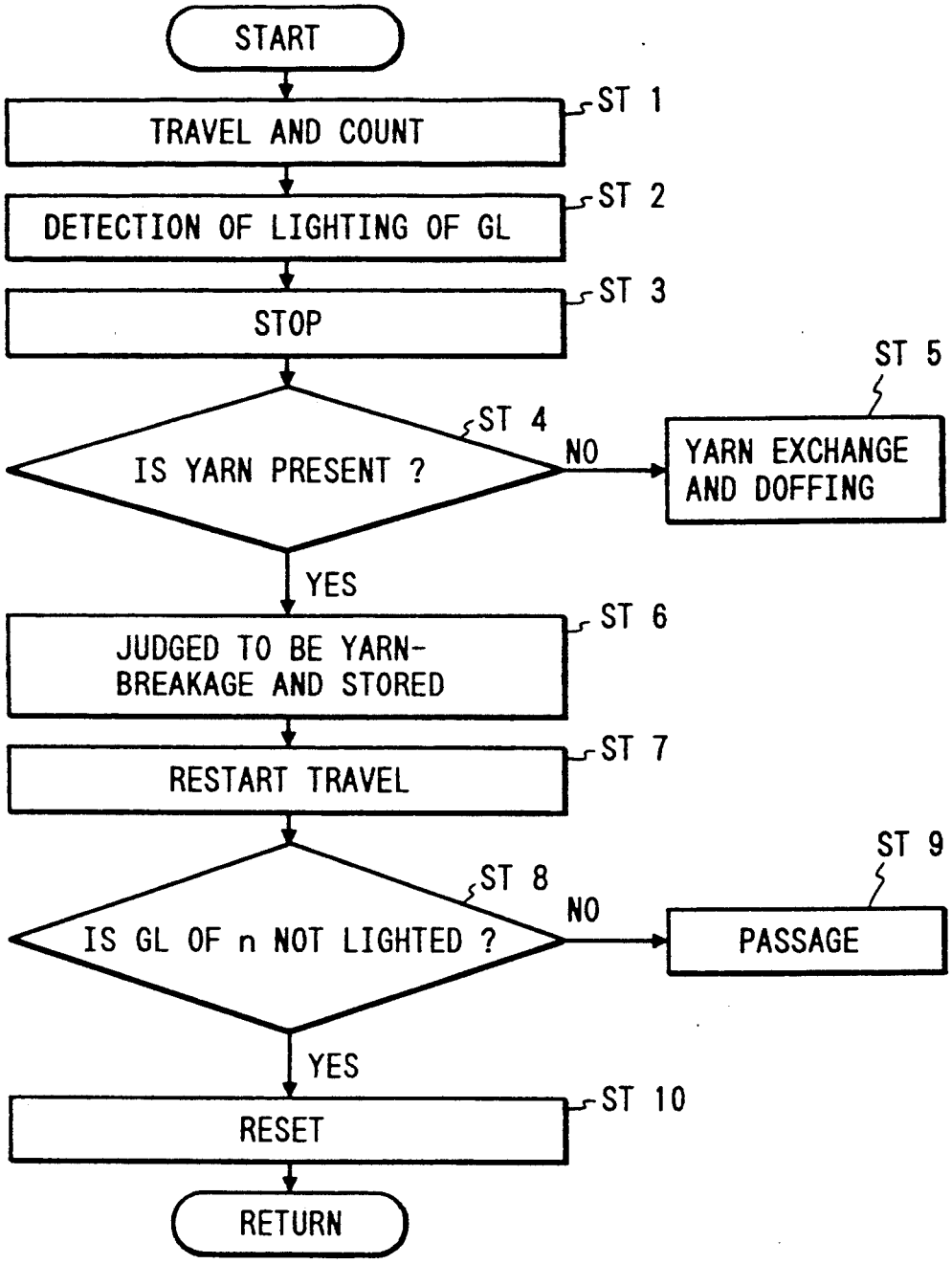
FIG. 3 is a flow chart for explaining the function of the present invention.

The operation of the present embodiment will be described hereinafter (see FIG. 3).

In each spindle 1 of the two-for-one twister, when the rotary drum 17 is driven to rotate the take-up tube 14, the yarn Y is drawn out of the yarn package 5 while double twisting it, which is wound on the take-up tube 14 to form the wound package 6. The carriage 33 with the device body 2 loaded thereon is reciprocated on the rails 34 and 36. At that time, a lot number (. . . n . . .) of the spindle 1 is detected by the magnet sensor 10 for sensing the magnet 8 of the spindle 1.

When a yarn breakage occurs and the drop wire 21 falls, the green lamp 7 is lit. When this is detected by the lamp sensor (ST 2), the controller 12 causes the travel and drive device 13 to be reduced in speed and stopped at a predetermined position opposedly of the spindle 1 (ST 3).

The extreme end of the operating arm 39 is extended to the yarn package 5, and the presence or absence of yarn is detected by the residual detection sensor 11 (ST 4).

When no yarn is present, judgement is made in which the winding package 6 is fully wound. The cradle arm 17 is operated by the operating lever 45 of the doffing mechanism 32 and the tray 46 to knock the fully wound package 6 onto the delivery conveyor 28, and a new take-up tube 14 is supplied to the cradle arm 15 by the take-up tube supply arm 51. At the same time, an empty yarn package is removed by the operating arm 39 of the yarn exchange mechanism 31 and the fully wound package 5 is set to the spindle 4 (ST 5).

In the case where a yarn is present, judgement is made by the controller 12 to be a yarn breakage halfway. A lot number (n) of the spindle 1 is stored (ST 6), and an instruction is provided for the travel and drive device 13 to restart travel (ST 7).

When the device body 2 which has been moved around again arrives at the spindle 1, the green lamp is detected (ST 8). If the lamp is kept lit, the device body 2 passes and the stoppage of the carriage 33 and the detection of residual yarn by the operating arm 39 are not effected (ST 9).

If the green lamp 7 is turned off, an operator regards it that piecing of the yarn breakage spindle 1 is made. The stored lot number (n) is reset (ST 10), and the device continuously travels to detect a yarn breakage and full package.

As described above, the device body 2 provided with the yarn exchange mechanism 31 and the doffing mechanism 32 is provided with the end-breakage spindle passing mechanism 3 which stores the end breakage spindle 1 prior to assuming a full package and allows the device body to pass when the device body again arrives at the spindle 1 in the same state. Therefore, the carriage 33 is prevented from being repeatedly stopped with respect to the spindle 1 for which yarn exchange and doffing are not necessary. That is, improvement of efficiency is achieved.

It is to be noted that the yarn exchange mechanism 31 and doffing mechanism 32 provided on the device body 2 are not limited to those described in the aforementioned embodiment but any means having a similar function may be employed.

Figure 2:
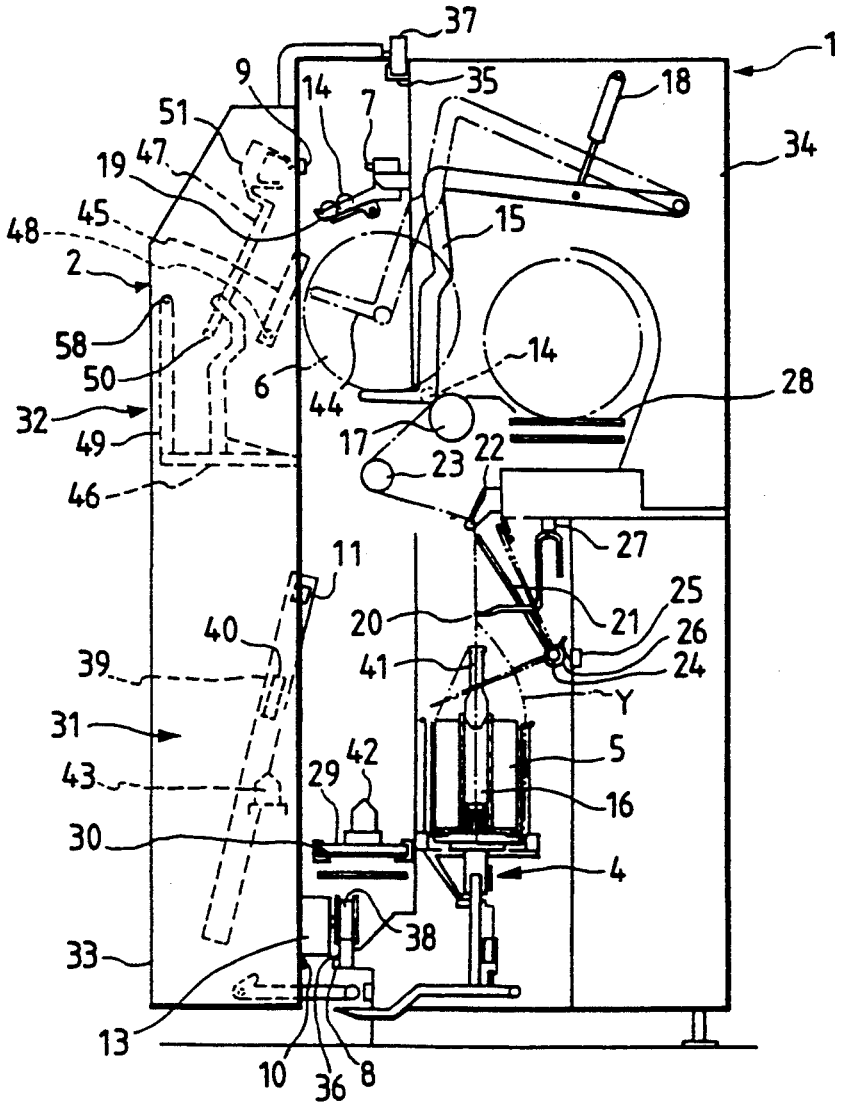
FIG. 2 is a side view of the same.

Moreover, while in FIG. 2, a single doubled package has been shown as a yarn package 5, it is to be noted that even a two-stage type yarn package in which packages not doubled are overlaid one above the other can be of course applied.

In short, according to the present invention, the following excellent effect is provided.

The device body for carrying out yarn exchange and doffing of spindles in a two-for-one twister is provided with a yarn breakage spindle passing mechanism which stores a yarn breakage spindle and allows the device body to pass when the device body agains arrives at the spindle in the same state. Therefore, the yarn exchange and doffing operation are prevented from being repeatedly stopped with respect to the unnecessary spindle, thus preventing the efficiency from being lowered.

What is claimed is:

1. A yarn exchange and doffing device for use on a two-for-one twister having a plurality of spindles for feeding yarn from a yarn feed package to a wound package, comprising:

propelling means for moving the device past the spindles;

exchange means for effecting yarn exchange and doffing;

detector means for detecting a location of a spindle where yarn is not being fed from the yarn feed package to the wound package and for stopping the device at a detected location;

sensor means for sensing the absence of yarn on the yarn feed package at the detected location; and a controller including means, responsive to a failure by the sensor means to sense the absence of yarn on the yarn feed package at the detected location, for preventing the exchange means from effecting yarn exchange and doffing and for restarting the device, means for storing a detected location at which the sensor means has failed to sense the absence of yarn on the yarn feed package as a broken yarn location, and means for preventing the detector means from subsequently stopping the device at the broken yarn location.

2. A yarn exchange and doffing device as described in claim 1, wherein each spindle of the two-for-one twister includes a magnet and indicating means to indicate when yarn is not being fed from the yarn feed package to the wound package, the detector means comprising:

an indication means sensor to sense the indicating means; and a magnet sensor.

3. A yarn exchange and doffing device as described in claim 1, wherein the sensor means comprises a residual yarn detection sensor, the device further comprising an arm for supporting the residual yarn detection sensor.

* * * * *